US008671619B2

(12) United States Patent
Stenzel et al.

(10) Patent No.: US 8,671,619 B2
(45) Date of Patent: Mar. 18, 2014

(54) DRIVE APPARATUS FOR A SWING-OUT ELEMENT OF A MOTOR VEHICLE

(75) Inventors: Manfred Stenzel, Bamberg (DE); Uwe Sommer, Effelder (DE)

(73) Assignee: Brose Fahrzeugteile GmbH & Co. Kommanditgesellschaft, Hallstadt (DE)

( * ) Notice: Subject to any disclaimer, the term of this patent is extended or adjusted under 35 U.S.C. 154(b) by 316 days.

(21) Appl. No.: 12/395,059

(22) Filed: Feb. 27, 2009

(65) Prior Publication Data

US 2009/0249698 A1 Oct. 8, 2009

(30) Foreign Application Priority Data

Mar. 6, 2008 (DE) ..... 20 2008 003 170 U

(51) Int. Cl.
*E05F 11/00* (2006.01)
*E05F 15/12* (2006.01)

(52) U.S. Cl.
USPC ..... 49/324

(58) Field of Classification Search
USPC ..... 49/324, 325, 327, 147
See application file for complete search history.

(56) References Cited

U.S. PATENT DOCUMENTS

| | | | | | |
|---|---|---|---|---|---|
| 3,728,820 | A * | 4/1973 | Lange | 49/346 |
| 4,068,408 | A * | 1/1978 | Hauber | 49/324 |
| 4,249,771 | A * | 2/1981 | Gergoe et al. | 296/146.16 |
| 4,918,865 | A * | 4/1990 | Hirai | 49/347 |
| 5,140,771 | A * | 8/1992 | Moy et al. | 49/340 |
| 5,161,419 | A * | 11/1992 | Moy et al. | 74/42 |
| 5,203,113 | A * | 4/1993 | Yagi | 49/324 |
| 5,385,061 | A * | 1/1995 | Moy et al. | 74/42 |
| 5,438,801 | A * | 8/1995 | Ishihara et al. | 49/357 |
| 5,680,728 | A * | 10/1997 | Moy | 49/324 |
| 5,901,500 | A * | 5/1999 | Tsuda et al. | 49/324 |
| 5,966,871 | A * | 10/1999 | Tsuda et al. | 49/324 |
| 6,056,348 | A * | 5/2000 | Tsuda et al. | 296/146.16 |
| 6,073,995 | A * | 6/2000 | Klein | 296/216.02 |
| 6,195,940 | B1 * | 3/2001 | Moy | 49/324 |
| 6,446,390 | B1 * | 9/2002 | Bandemer et al. | 49/324 |
| 6,561,055 | B1 * | 5/2003 | Turk | 74/425 |
| 6,834,463 | B2 * | 12/2004 | Fukumoto et al. | 49/341 |
| 2002/0148164 | A1 * | 10/2002 | Bandemer et al. | 49/324 |
| 2003/0019057 | A1 * | 1/2003 | Dickie | 15/22.1 |
| 2005/0072049 | A1 * | 4/2005 | Spaziani et al. | 49/349 |
| 2005/0091928 | A1 * | 5/2005 | Okulov et al. | 49/341 |

FOREIGN PATENT DOCUMENTS

| | | | |
|---|---|---|---|
| DE | 41 07 270 | A1 | 9/1992 |
| DE | 42 18 507 | A1 | 1/1993 |
| DE | 196 23 317 | A1 | 12/1997 |
| DE | 198 49 246 | A1 | 5/2000 |
| DE | 102 09 923 | A1 | 9/2003 |
| EP | 0 964 975 | B1 | 2/2001 |

* cited by examiner

*Primary Examiner* — Katherine Mitchell
*Assistant Examiner* — Justin Rephann
(74) *Attorney, Agent, or Firm* — Muncy, Geissler, Olds & Lowe, P.C.

(57) ABSTRACT

In a drive apparatus for a swiveling swing-out element of a motor vehicle, in particular for a swing-out window, which is adjustable between an open position and a closed position, an adjusting lever that is flexurally elastic in the x direction in relation to the motor vehicle coordinate system is provided for compensating the swivel movement of the swing-out element.

16 Claims, 1 Drawing Sheet

DRIVE APPARATUS FOR A SWING-OUT ELEMENT OF A MOTOR VEHICLE

This nonprovisional application claims priority under 35 U.S.C. §119(a) to German Patent Application No. 20 2008 003 170.2, which was filed in Germany on Mar. 6, 2008 , and which is herein incorporated by reference.

BACKGROUND OF THE INVENTION

1. Field of the Invention

The invention relates to a drive apparatus for a swing-out element of a motor vehicle, the swing-out element being adjustable between an open position and a closed position, using an adjusting lever. In this case, a swing-out element is understood to be, in particular, a swiveling, i.e. unilaterally hinged, swing-out closing part, for example a swing-out window, a pop-up roof or the like.

2. Description of the Background Art

A linear drive is known from DE 198 49 246 A1, in which an electric motor moves a telescopically movable adjusting rod, which is connected to a swing-out side window of a vehicle, in a linear fashion via a gear unit. The adjusting rod is connected to the swing-out side window, which is hinged on one side to the vehicle body, using at least one ball-and-socket joint, so that the linear movement path described by the end of the adjusting rod is converted to a curved movement path.

In an apparatus known from DE 196 23 317 C2 for operating unilaterally hinged components, such as swing-out windows, pop-up roofs, covers, hoods or the like, a linear drive having a spindle of a multistage design is run on bearings that allow swiveling around the motor axis, for the purpose of compensating angular changes when adjusting the component during its swivel movements. An additional swivel movement around a plane positioned vertically thereto is carried out via a ball-and-socket bearing holding the linear drive, or via a universal joint in the spindle.

In a window actuator known from DE 42 18 507 C2, comprising an electric motor drive and a multistage spindle gear unit as well as comprising a swivel lever mechanism having two rotationally movable, interconnected levers, a ball-bearing-like articulated joint connection, in turn, is provided in the connection between the swivel lever mechanism and the swiveling side window.

SUMMARY OF THE INVENTION

It is therefore an object of the present invention to provide a particularly suitable drive apparatus for a swing-out element of a motor vehicle, preferable for a swiveling side or swing-out window. In particular, the swing-out forces are to be reliably transmitted and operation-induced movements compensated.

According to the invention, this object is achieved by the features of claim 1. For this purpose, an adjusting lever is provided, which is flexurally elastic in the x direction in relation to the motor vehicle coordinate system and compensates the swivel movement of the swing-out element. In other words, the adjusting lever that is flexurally elastic in the x direction makes it possible to particularly easily and reliably adapt the linear adjusting movement of the adjusting level to the curved, in particular, arc-shaped, movement path of a connecting point between the swing-out element and the end of the adjusting lever assigned thereto, along the adjusting path between an open position and a closed position of the swing-out element.

The adjusting lever is compressively rigid in the y direction and, in addition, suitably flexurally rigid in the z direction. The adjusting lever, which is suitably made of spring steel (spring wire), has a rectangular cross-section, its narrow side running in the x direction and longitudinal side running in the z direction.

Between the swing-out element and the preferably electric motor drive, the drive apparatus therefore has a connection in the form of the connecting lever, which compensates typical manufacturing tolerances and operation-induced, curved swivel movements at least in the x direction, as a result of its flexural elasticity. However, the adjusting lever is compressively rigid in the y direction, such that the swing-out forces are transmitted without deforming the adjusting lever. An at least slight tolerance and/or movement compensation in the z direction is suitably achieved by connecting the adjusting lever to the swing-out element in an articulated manner. Due to its flexural elasticity in the x direction, the adjusting lever may also accommodate tolerances for connecting the window in the closed position.

In a particularly preferred specific embodiment, the adjusting lever is swivelably held by its end opposite the swing-out element at a pivot point (pivot position) of a driving gear that may be swiveled around a rotary axle. Like the swivel axle in the connection between the adjusting lever and the swing-out element, this swivel axle runs at least largely in the x direction. The rotary axle of the swiveling driving gear also runs in the x direction.

The driving gear, from whose rotary axle the pivot point or pivot location of the adjusting lever is spaced at a suitable distance in the radial direction, is preferably part of a multistage reduction gear unit. This gear unit, in turn, is suitably designed as a worm gear unit having a worm gear that drives the driving gear via an intermediate toothed gear. In the closed position of the swing-out element, the pivot point is located on the side of the rotary axle opposite the swing-out element, where it lies below this rotary axle. This achieves an intrusion-proof blocking position of the drive apparatus.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
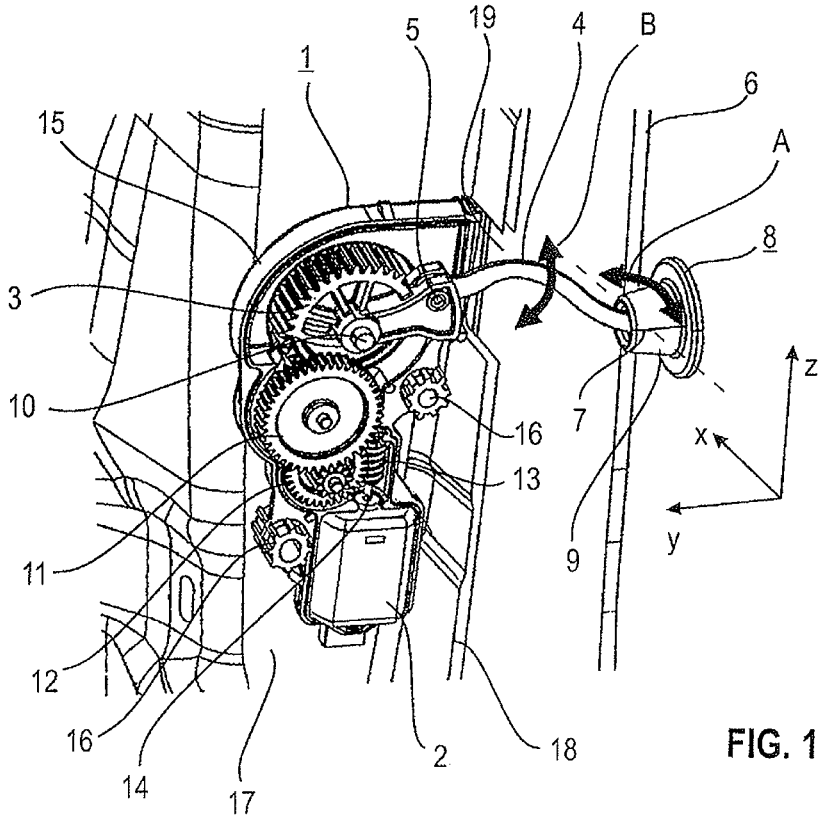
FIG. 1 shows a partial perspective view of a drive apparatus according to the invention, including an adjusting lever driven by an electric motor in an open position of a swing-out window in an open housing.

In both figures, corresponding parts are provided with the same reference numerals.

Drive apparatus 1 comprises an electric motor 2, which drives a driving gear 3. The latter, in turn, is coupled with an adjusting lever 4 at a pivot point 5. Adjusting lever 4 is coupled to a hinged swing-out window 6, which is swivelable on one side in a manner that is not shown in greater detail, in a cup-type retaining element 8 via a bearing 7. This retaining element is permanently connected to swing-out window 6. The bearing axis of bearing 7, which is represented by a dotted line, runs at least approximately parallel to the x axis (x direction) of the illustrated motor vehicle coordinate system. The actual bearing arrangement, preferably in the form of a swivel bearing, is located within a holding dome 9 of retaining element 8, which is suitably glued to swing-out window 6 over a large area of its back side.

Driving gear 3, which is run on bearings that allow swiveling around rotary axis 10 fixed to the housing, is driven via a multistage reduction gear unit having a toothed gear 11, which, in turn, is coupled with driving gear 3, on the one hand, and with a worm gear 12, on the other hand. This worm gear, in turn, meshes with a worm 13, which is situated on a drive shaft 14 of electric motor 2. Electric motor 2 and gear unit 10, 11, 12, are situated in a two-part housing, of which only rear housing part 15 is visible when the housing halves are disassembled.

Drive apparatus 1 is mounted by fastening elements 16 to vehicle body 17, for example in the area of the C or D column, in a flange area 18 of a side wall or a door frame at the back of the motor vehicle. Adjusting lever 4 of drive apparatus 1 is guided outwardly to swing-out window 6 and, in this location, to retaining element 8, by a flange opening 19 that is rectangular in the exemplary embodiment.

Adjusting lever 4, which is connected to driving gear 3 forming the final toothed gear stage of the reduction gear unit, is made of a spring wire (spring steel) and, due to its preferably rectangular cross-section, is compressively rigid in the y direction and flexurally rigid in the z direction. The narrow side of the adjusting lever cross-section located on the xz plane therefore runs in the x direction, while its longitudinal side runs in the z direction.

Adjusting lever 4 is flexurally elastic in the x direction. Arrow A indicates the flexural elasticity in the x direction, while arrow B shows a certain swivel movement of adjusting lever 4 around the x axis in the z direction.

Figure 2:
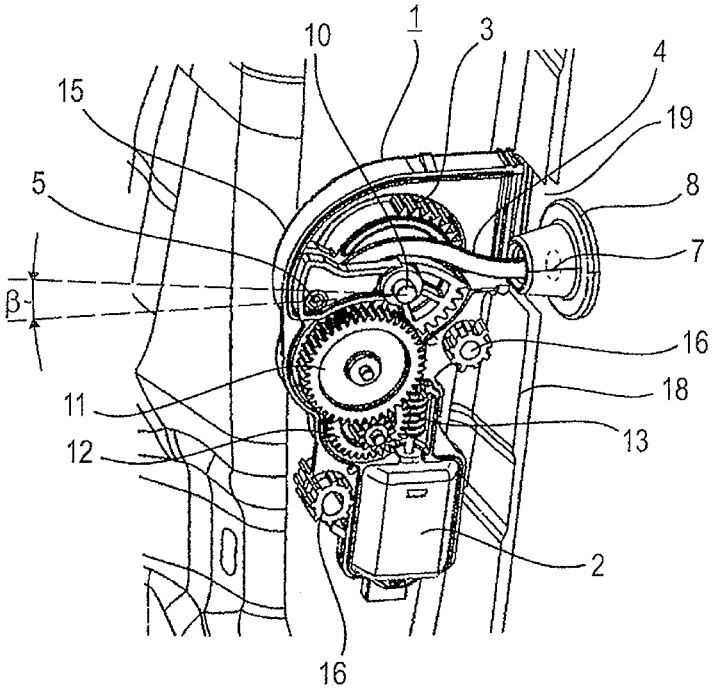
FIG. 2 shows the drive apparatus in a view according to FIG. 1, in which the swing-out window is in the closed position.

Adjusting lever 4, which is flexurally elastic in the x direction, may also particularly easily and reliably compensate swivel movements of unilaterally hinged swing-out window 6, when the window swings into the open position (FIG. 1) or into its closed position (FIG. 2). Window connection tolerances may also be accommodated in the closed position. Tolerances in the z direction are compensated via the pivot point and/or bearing 5 and/or 7 of adjusting lever 4.

In the closed position illustrated in FIG. 2, pivot point 5 is located on the side of rotary axle 10 opposite swing-out window 6, where it lies below this rotary axle 10 of driving gear 3. This is illustrated by rotation angle $\beta \approx 20°$, by which a 180° rotation angle position is exceeded when swing-out window 6 is closed to approximately 200°. In this manner, swing-out window 6 is moved to an intrusion-proof blocking position, and a window frame seal (not illustrated) is relieved.

In a suitable embodiment, a stop and/or sliding surface for adjusting lever 4 is formed on driving gear 3 in order to avoid noise resulting from adjusting lever 4 coming to rest against the tooth profiles.

Drive apparatus 1, which is installed in a hidden location in flange area 18 of vehicle body 17, takes up very little space. Adjusting lever 4, which is flexurally elastic in the x direction, compressively rigid in the y direction and flexurally rigid in the z direction, may be manufactured in a single piece, which makes it particularly cost-effective. The mobility of adjusting lever 4 in the x direction is particularly easy to implement from a manufacturing perspective for compensating the swivel movements of swing-out window 6, due to the lever's flexural elasticity, and this mobility is achieved while practically minimizing the installation space. Drive apparatus 1 is therefore suitable for other unilaterally hinged closing parts of a motor vehicle for closing vehicle body openings. These may be, in principle, a pop-up roof, a cover, a hood or the like.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A drive apparatus for a swing-out element of a motor vehicle wherein said vehicle has a first surface extending in a first direction and a second direction orthogonal to said first direction and said apparatus is adapted to be mounted on said vehicle surface and extending outward from said first surface in a third direction orthogonal to said first and second direction, said apparatus including:

an adjusting lever for adjusting said swing-out element between an open position and a closed position, the adjusting lever having a rectangular cross section in a plane perpendicular to the length and coupled to a driving gear;

a swivel bearing disposed at an end of the adjusting lever; and a retaining element having a circular opening configured to couple the adjusting lever to the swing-out element, said end of the adjusting lever being rotatably disposed within the circular opening, wherein said adjusting lever is flexurally elastic in the third direction for compensating for swivel movement of the swing-out element, wherein the adjusting lever is a unitary piece of material, and wherein a width of the adjusting lever is continuous along an entire length of the adjusting lever between the retaining element and the driving gear, and wherein a thickness of the adjusting lever is continuous along an entire length of the adjusting lever between the retaining element and the driving gear.

2. The drive apparatus according to claim 1, wherein the adjusting lever is compressively rigid in the second direction.

3. The drive apparatus according to claim 1, wherein the adjusting lever is flexurally rigid in the first direction.

4. The drive apparatus according to claim 1, wherein the adjusting lever is made of a spring steel.

5. The drive apparatus according to claim 1, wherein a narrow side of the adjustment lever runs in the third direction and a longitudinal side runs in the first direction.

6. The drive apparatus according to claim 1, wherein the adjusting lever is held at a pivot point of the driving gear that is swivelable around a rotary axle.

7. The drive apparatus according to claim 6, wherein the pivot point is spaced at a distance in the radial direction from the rotary axle of the driving gear.

8. The drive apparatus according to claim 6, wherein, when the swing-out element is closed, the pivot point is located beneath the rotary axle on the side thereof opposite the swing-out element in a blocking position.

9. The drive apparatus according to claim 6, wherein a multistage reduction gear unit having a worm gear that is coupled with the driving gear and meshes with a worm situated on the drive shaft of an electric motor.

10. The drive apparatus of claim 1 wherein said swing-out element is a swiveling swing-out window.

11. The drive apparatus of claim 1, wherein the adjusting lever consists of a single elongate component.

12. The drive apparatus of claim 11, wherein a first end of the adjusting lever is connected directly to the driving gear and a second end of the adjusting lever is connected directly to the swing-out element.

13. A drive apparatus for a swing-out element of a motor vehicle, the swing out element being connected to the vehicle for pivotable movement between closed and open positions, the drive apparatus being connected to the vehicle and comprising:

a drive;

an adjusting lever having a first end connected to the drive and a second end connected to a location on the swing-out element, the location following a curved path as the swing-out element moves between the closed and open positions, the adjusting lever having a length, a width and a thickness and extending from the drive to the swing-out element, the adjusting lever having a rectangular cross section in a plane perpendicular to the length;

a swivel bearing disposed at the second end of the adjusting lever; and a retaining element having a circular opening configured to couple the adjusting lever to the swing-out element, said second end of the adjusting lever being rotatably disposed within the circular opening, wherein the adjusting lever is sufficiently flexible in the direction of the strip thickness to allow the second end to flex and follow the curved path as the swing-out element moves between the closed and open positions, wherein the adjusting lever is a unitary strip of material, and wherein the width of the adjusting lever is continuous along an entire length of the adjusting lever between the retaining element and the drive, and the thickness of the adjusting lever is continuous along the entire length of the adjusting lever between the retaining element and the drive.

14. The drive apparatus of claim 13, wherein the adjusting lever comprises spring steel.

15. The drive apparatus of claim 13, wherein the swing-out element comprises a window.

16. The drive apparatus of claim 13, wherein the first end of the adjusting lever is connected directly to the drive and the second end of the adjusting lever is connected directly to the swing-out element.

* * * * *